US008065769B2

(12) United States Patent
Krimpen et al.

(10) Patent No.: US 8,065,769 B2
(45) Date of Patent: Nov. 29, 2011

(54) METHOD AND APPARATUS FOR THE PLACEMENT OF A BRIDGE ELEMENT

(75) Inventors: Detlef Van Krimpen, Kempen (DE); Joachim Hammes, Hattersheim (DE); Stefan Parthon, Mainz (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 255 days.

(21) Appl. No.: 12/297,999

(22) PCT Filed: Apr. 19, 2007

(86) PCT No.: PCT/DE2007/000692

§ 371 (c)(1),
(2), (4) Date: Oct. 31, 2008

(87) PCT Pub. No.: WO2007/121719

PCT Pub. Date: Nov. 1, 2007

(65) Prior Publication Data

US 2009/0089943 A1 Apr. 9, 2009

(30) Foreign Application Priority Data

Apr. 22, 2006 (DE) ..... 10 2006 018 794

(51) Int. Cl.
*E01D 15/12* (2006.01)
*E01D 15/10* (2006.01)

(52) U.S. Cl. ..... 14/2.5; 14/2.4

(58) Field of Classification Search ..... 14/2.5, 14/77.1, 2.4

See application file for complete search history.

(56) References Cited

U.S. PATENT DOCUMENTS

| | | | | | |
|---|---|---|---|---|---|
| 3,492,683 | A * | 2/1970 | Kinzel et al. | 14/2.5 |
| 4,288,881 | A * | 9/1981 | Mahncke et al. | 14/2.5 |
| 4,498,562 | A * | 2/1985 | Piepenbreier | 188/58 |
| 4,663,793 | A * | 5/1987 | Parramore | 14/2.5 |
| 5,117,525 | A * | 6/1992 | Karcher | 14/2.5 |
| 5,443,584 | A | 8/1995 | Diefendahl et al. | |
| 5,507,057 | A | 4/1996 | Diefendahl et al. | |
| 5,862,557 | A * | 1/1999 | Aubert | 14/2.4 |
| 5,915,423 | A * | 6/1999 | Thomas | 14/2.4 |
| 5,937,468 | A * | 8/1999 | Wiedeck et al. | 14/2.5 |
| 5,940,916 | A * | 8/1999 | Sauvageot | 14/2.5 |
| 7,014,014 | B2 * | 3/2006 | Mueller | 187/305 |
| 7,174,591 | B2 * | 2/2007 | Bertrand et al. | 14/2.5 |

FOREIGN PATENT DOCUMENTS

| | | |
|---|---|---|
| DE | 2 252 428 | 10/1972 |
| DE | 37 38 763 | 5/1989 |
| DE | 196 50 654 | 6/1998 |
| EP | 0 685 599 | 1/2000 |
| JP | 05 033312 | 2/1993 |

* cited by examiner

*Primary Examiner* — Thomas Will
*Assistant Examiner* — Abigail A Risic
(74) *Attorney, Agent, or Firm* — Robert Becker; Robert Becker & Associates

(57) ABSTRACT

A method and apparatus for the placement of a bridge element using a vehicle having a placement arm, and a use of the apparatus. The placement arm has at least one drive element adapted to cooperate with the bridge element. A braking device is disposed in the vicinity of the deposition end of the placement arm and cooperates with the bridge element during a placement procedure. The bridge element is braked via an engagement element of the braking device. Movement of the bridge element in a longitudinal direction can be measured and monitored, and in the event of an uncontrolled movement the bridge element can be braked.

20 Claims, 8 Drawing Sheets

METHOD AND APPARATUS FOR THE PLACEMENT OF A BRIDGE ELEMENT

BACKGROUND OF THE INVENTION

The instant application should be granted the priority dates of Apr. 22, 2006, the filing date of the corresponding German patent application 10 2006 018 794.6, as well as Apr. 19, 2007, the filing date of the International patent application PCT/DE2007/000692.

The present invention relates to two methods for the placement of a bridge element, an apparatus for the placement of a bridge element as well as a use of this apparatus.

The invention can be used on civilian and military wheeled or chained vehicles for the laying or placement of portable bridges, which generally consist of a plurality of individual bridge elements carried along with the vehicle. For the placement of the bridge elements, which are generally symmetrical in the longitudinal and transverse directions, such vehicles are provided with a pivotable placement arm. Disposed on the placement arm are drive elements that move the bridge elements in the longitudinal direction during the placement. As driving elements, the placement arm is frequently provided in particular with a pair of rail bar gears in the central region of the placement arm that cooperate with two corresponding rail bars on the bridge element and move the latter. As an aid, a further pair of rail bar gears is used that is disposed in the rear region of the placement arm.

The individual bridge elements are generally stacked upon the vehicle. During the placement, the uppermost bridge element is first moved toward the front with the placement arm, being guided in a horizontal plane in the longitudinal direction, so that it projects nearly entirely toward the front of the vehicle. In the event that further bridge elements are to be placed, a second bridge element from the stack is moved toward the front by means of the rail bar gears until it encounters the first bridge element, where the two bridge elements are rigidly coupled with one another. After the coupling, both bridge elements are moved toward the front until also the second bridge element projects nearly entirely toward the front of the vehicle. This process is repeated until the desired number of bridge elements have been coupled. The pivotable placement arm is then pivoted in a vertical plane in such a way that first the front end of the first bridge element is placed upon the ground, and subsequently the rear end of the last bridge element is placed upon the ground.

During the placement, the bridge element must be moved in a controlled manner. In particular, during deposit of the front end the bridge element must not come out of the guide and slip. The error free deposit of the bridge must in particular also be ensured on steep surfaces, for example on a river embankment, and with unfavorable ground conditions (e.g. muddy conditions). Due to the angular conditions that exist, the placement and taking up of only one bridge element is frequently more critical than the placement of a plurality of bridge elements.

The slipping of the bridge can, with the known apparatus, be prevented only by the used of additional auxiliary means. This includes, for example, the installation of chain hoists between the placement device and the bridge element, or between the bridge element and a fixed point in the immediate surroundings. A further possibility is to secure the bridge by using further portable devices such as fork lifts or salvage tanks. The drawback to this, however, is on the one hand high expense and on the other hand that the bridge cannot be entirely placed out of the armored vehicle, thus endangering the safety of personnel, in particular especially during combat.

It is an object of the present invention to prevent an uncontrolled, faulty movement of the bridge element during the placement and the taking-up.

SUMMARY OF THE INVENTION

The method of the invention realizes this object by providing the placement arm of a vehicle with at least one drive element that is adapted to cooperate with the bridge element, disposing a braking device in the vicinity of the deposition end of the placement arm, wherein the braking device is adapted to cooperate with the bridge element during a placement procedure, and braking the bridge element via an engagement element of the braking device. The method can also be realized by providing the placement arm of a vehicle with at least one drive element that is adapted to cooperate with the bridge element, disposing a braking device in the vicinity of the deposition end of the placement arm, wherein the braking device is adapted to cooperate with the bridge element during a placement procedure, measuring and monitoring movement of the bridge element in a longitudinal direction, and in the event of an uncontrolled movement of the bridge element, braking the bridge element via an engagement element of the braking device. The apparatus of the invention can realize the object by being comprised of a placement arm having at least one drive element that is adapted to cooperate with a bridge element, and at least one braking device disposed in the vicinity of the deposition end of the placement arm, wherein the braking device is provided with an engagement element that is adapted to cooperate with the bridge element during a placement procedure. Pursuant to a use of the apparatus during a process of taking-up a bridge element disposed in an elevated position, the placement arm is introduced into the bridge element such that the braking device engages into the bridge element, the braking device is securely braked, the bridge element is withdrawn from the elevated position via the braked braking device, the braking of the braking device is released, and the bridge element is taken up via the drive element of the placement arm.

A basic concept of the invention is that in the region of the deposition end of the placement arm, an engagement element of a braking device is disposed that cooperates with the bridge during the placement process. The braking device is capable of being braked, so that it can brake the bridge element, in particular by means of a braking element, thereby preventing an uncontrolled movement. The braking device, in particular the engagement element, can be disposed in the region of the deposition end, since at this point the bridge element is in contact with the displacement arm up to the time of deposition, i.e. as long as possible.

Pursuant to one possible embodiment, during the entire placement process the braking device exerts a braking effect upon the bridge element in order to prevent an uncontrolled movement from the outset.

Pursuant to a further embodiment, the speed of the movement of the bridge element can additionally be measured by means of at least one measuring element, and can be monitored by means of a monitoring element that is connected to the measurement element and that can include electronics. In the event of a faulty, uncontrolled movement, the monitoring element delivers an error signal for the braking, so that the placement process can be interrupted. The monitoring can, for example, be effected in such a way that the measured speed value is compared with a preset and in particular adjustable threshold value. As soon as the measured value exceeds the threshold value, the signal for the braking of the braking device is delivered. Thus, the braking device can include an engagement element, a braking element, a measurement element and a monitoring element.

The engagement element advantageously includes at least one rail bar braking gear that engages a rail arm or bar of the bridge element. A rotation encoder that includes electronics can be mounted on the rail bar braking gear for monitoring the rotational movement of the rail bar braking gear and hence the movement of the bridge element.

A multiple-disk brake, especially a hydraulically eased spring pressure multiple-disk brake, can be used as the braking element. For the purpose of reducing the braking moment, and hence reducing the component dimensions of the brake, a gear stage can be interposed between the braking element and the engagement element.

Pursuant to one advantageous embodiment, at least one roller element can be disposed in the region of the deposition end of the placement arm, whereby the bridge element is displaceably supported on the roller element. The roller element and the rail bar braking gear can be disposed in such a way that the rail bar of the bridge element is displaceably disposed between them during the placement. This ensures that the bridge element remains in contact with the displacement arm up to the time of the deposition.

The advantages of the invention are also obtained in an analogous manner during the taking-up of a bridge element with the placement arm.

In addition to providing securement against slippage, the braking device can also carry out further functions. It can be used in order to take up bridge elements that are located on an external stack of bridge elements, so that the placement arm cannot directly take up the bridge element from above. This was previously problematic due to the reason that the placement arm could not be introduced into the uppermost bridge element to such an extent that the drive element, in particular the rail bar driving gear, which is generally disposed in the central portion of the placement arm, could engage the rail bar. For this reason, the bridge element previously had to be pulled toward the front by the necessary amount, for example with a cable that was secured between the placement vehicle and the bridge element. Now, with the braking element the bridge element can be taken up without additional auxiliary means. In this connection, the vehicle is moved up to the bridge element until the braking element engages the bridge element. The braking element is securely braked, and the bridge element is pulled toward the front by means of the braked braking element until the drive element, in particular the rail bar driving gear, can engage the rail bar. It is particularly advantageous to measure the introduction depth of the placement arm into the bridge element by means of the rotation encoder and to display this in the interior of the vehicle.

Pursuant to a further advantageous embodiment, the engagement element is designed to be driven. In this case, the braking effect of the braking device can already result from the drive, so that no additional braking elements have to be provided. The braking effect can furthermore also result from a self-locking of the engagement element.

BRIEF DESCRIPTION OF THE DRAWINGS

Possible embodiments of the invention are illustrated in FIGS. 1 to 10, in which.

DESCRIPTION OF SPECIFIC EMBODIMENTS

Figure 1:
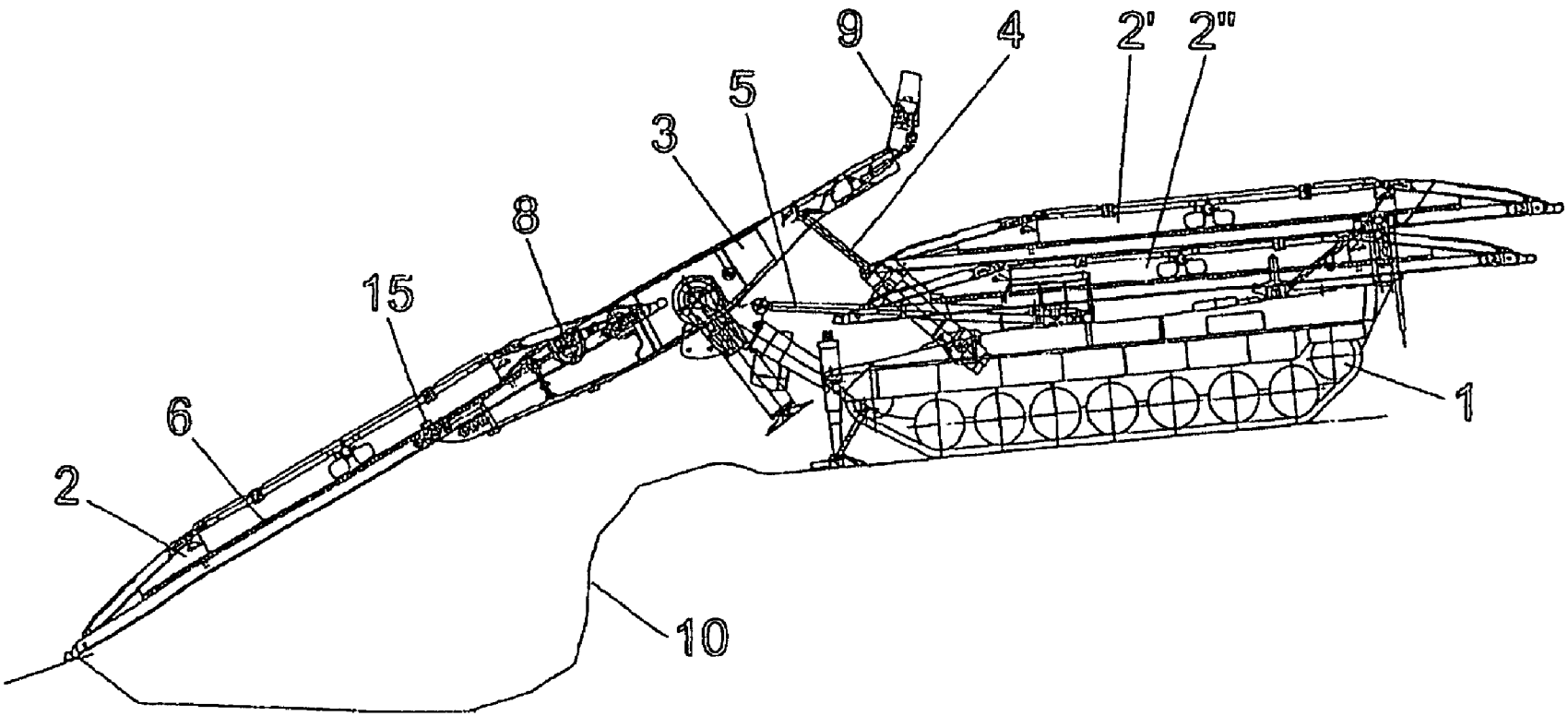
FIG. 1: is a side view of a placement vehicle during the laying or placement of a bridge element that is in engagement with the drive element.

FIG. 1 shows a placement vehicle 1 having a chain drive, the vehicle being designed for transporting three bridge elements 2, 2' and 2". The vehicle 1 has a laying or placement arm 3, which is pivotable in a vertical plane via the pivot cylinders 4 and 5. Disposed on the placement arm 3 is a bridge element 2 that is to be deposited in order to bridge or span the ditch 10. The front end of the bridge element 2 is already deposited on the ground.

The bridge element 2 has a symmetrical configuration in the longitudinal direction, and is provided on each side with a rail arm or bar 6. The bridge element 2 is moved on the placement arm 3 by means of two drive elements in the form of rail bar driving gears 8, which are in engagement with the rail bars 6. In the rear region, the placement arm 3 is furthermore provided with an auxiliary rail bar gear 9.

Figure 2:
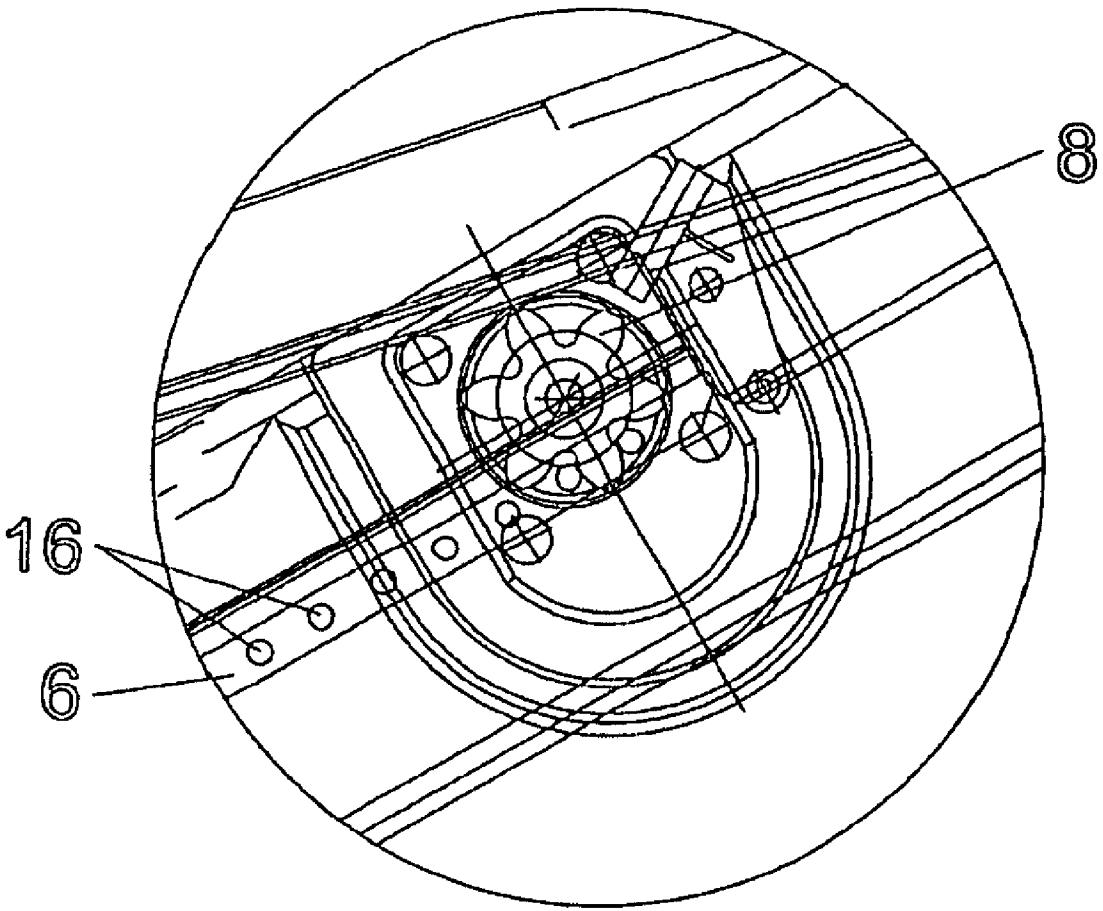
FIG. 2: shows the drive element of FIG. 1 in an enlarged view.

The region of the rail bar driving gear is shown enlarged in FIG. 2. The rail bar driving gear 8 is in engagement with the rail bar 6 via the rail bar pins 16.

Figure 3:
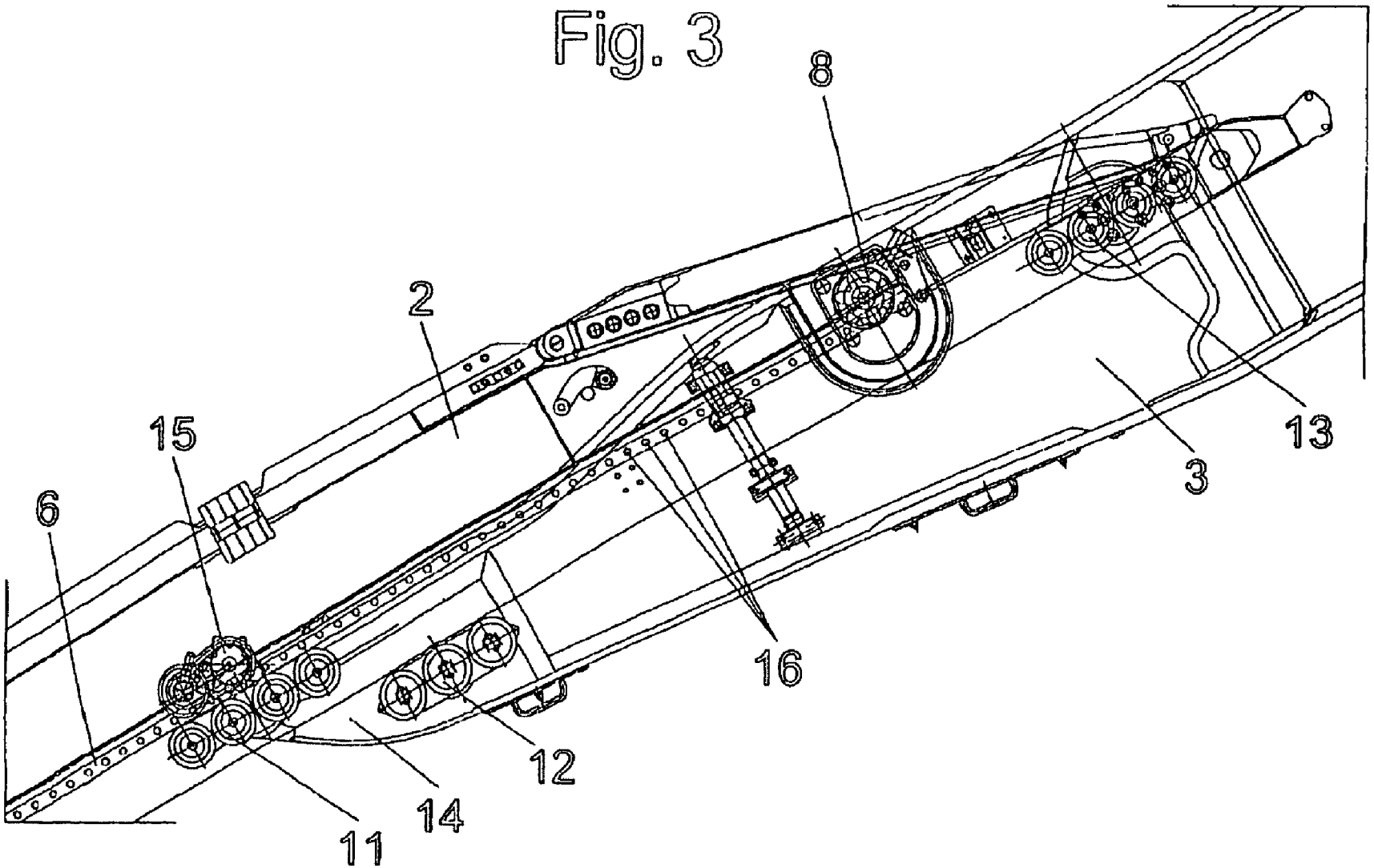
FIG. 3: is an enlarged view of a portion of the placement arm of FIG. 1, FIG. 4: is a side view of the placement vehicle during the placement of a bridge element that is not in engagement with the drive element.

FIG. 3 shows the forward portion of the placement arm 3 of FIG. 1 with the bridge element 2 in an enlarged illustration. The placement arm is provided with a plurality of roller elements 11, 12 and 13 upon which the bridge element 2 is displaceably supported. Disposed in the region of the deposition end 14, as an engagement or braking element, is a rail bar braking gear 15, which also engages in the rail bar 6, and the function of which will be described subsequently.

Figure 4:
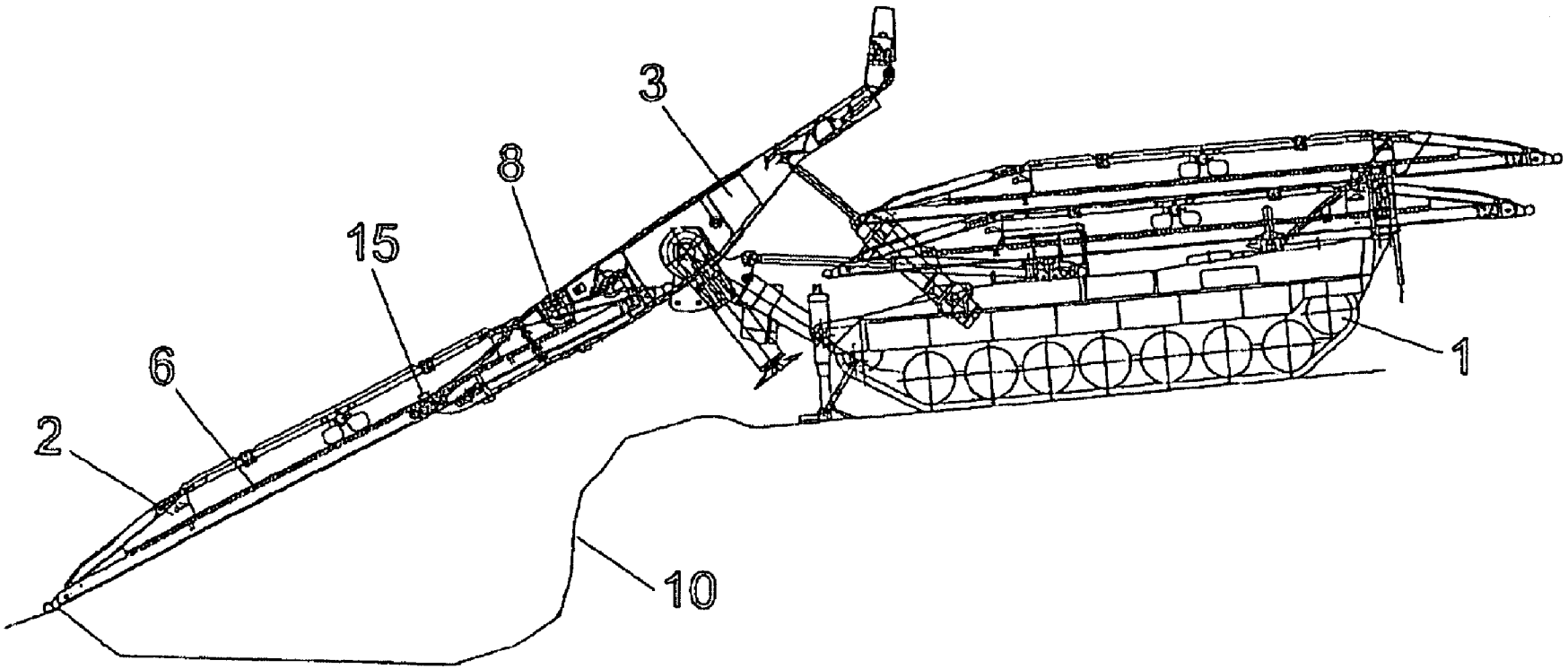
Figure 5:
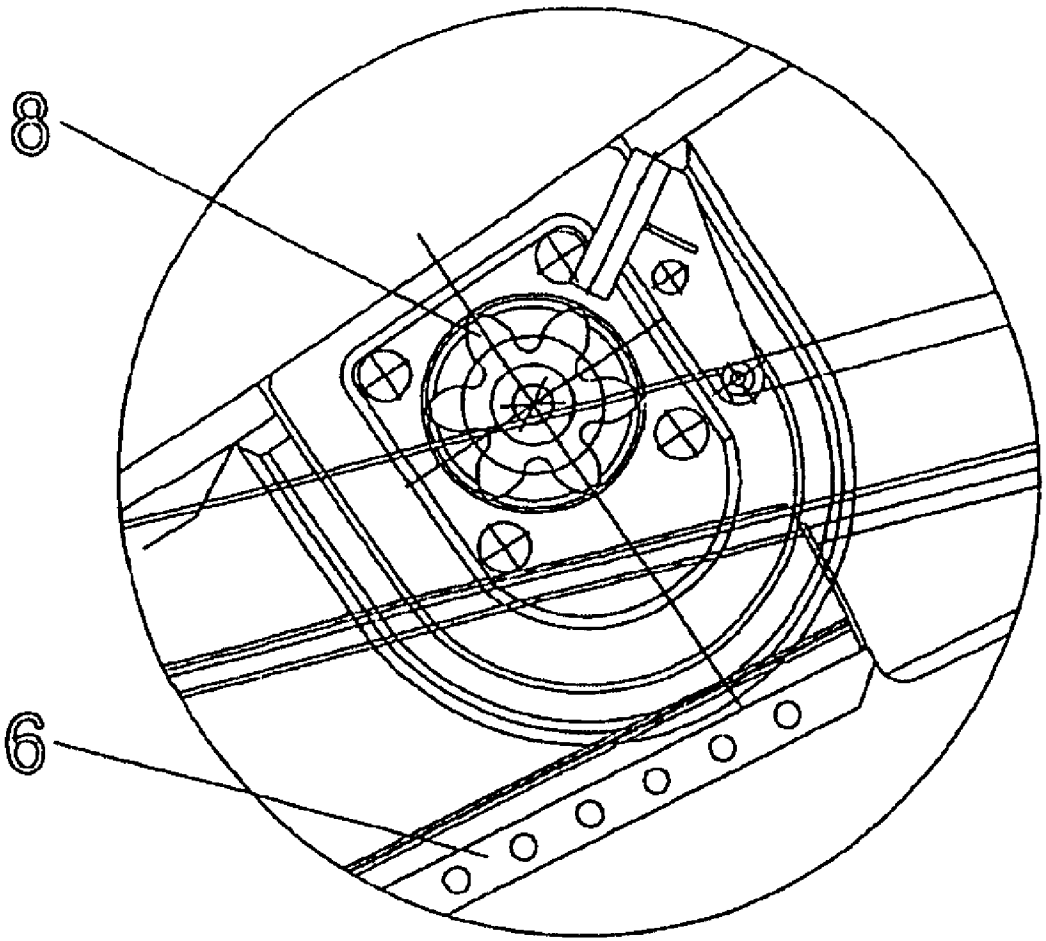
FIG. 5: shows the drive element of FIG. 4 in an enlarged view.

FIG. 4 shows the placement vehicle 1 in a position in which the rear end of the bridge element 2, which is connected to the placement arm 3, is further lowered relative to the illustration of FIG. 1. The rail bar driving gear 8 is raised over the rail bar 6, so that they are no longer in engagement, whereby this effect is reinforced by the very steep ditch 10 that is to be spanned. This is also shown in the enlarged illustration of FIG. 5. In the position shown in FIG. 4, the movement of the bridge element 2 can no longer be controlled by the rail bar driving gear 8. Were no additional means to be provided, the bridge element 2 could, under unfavorable ground conditions, slip toward the front. To prevent this, the rail bar braking gear 15 is disposed in the region of the deposition end 14 of the placement arm 3; in the position in FIG. 4, the rail bar braking gear 15 is also not in engagement with the rail bar 6.

The rail bar braking gear 15 is activated to brake during the movement of the bridge element 2.

Figure 6:
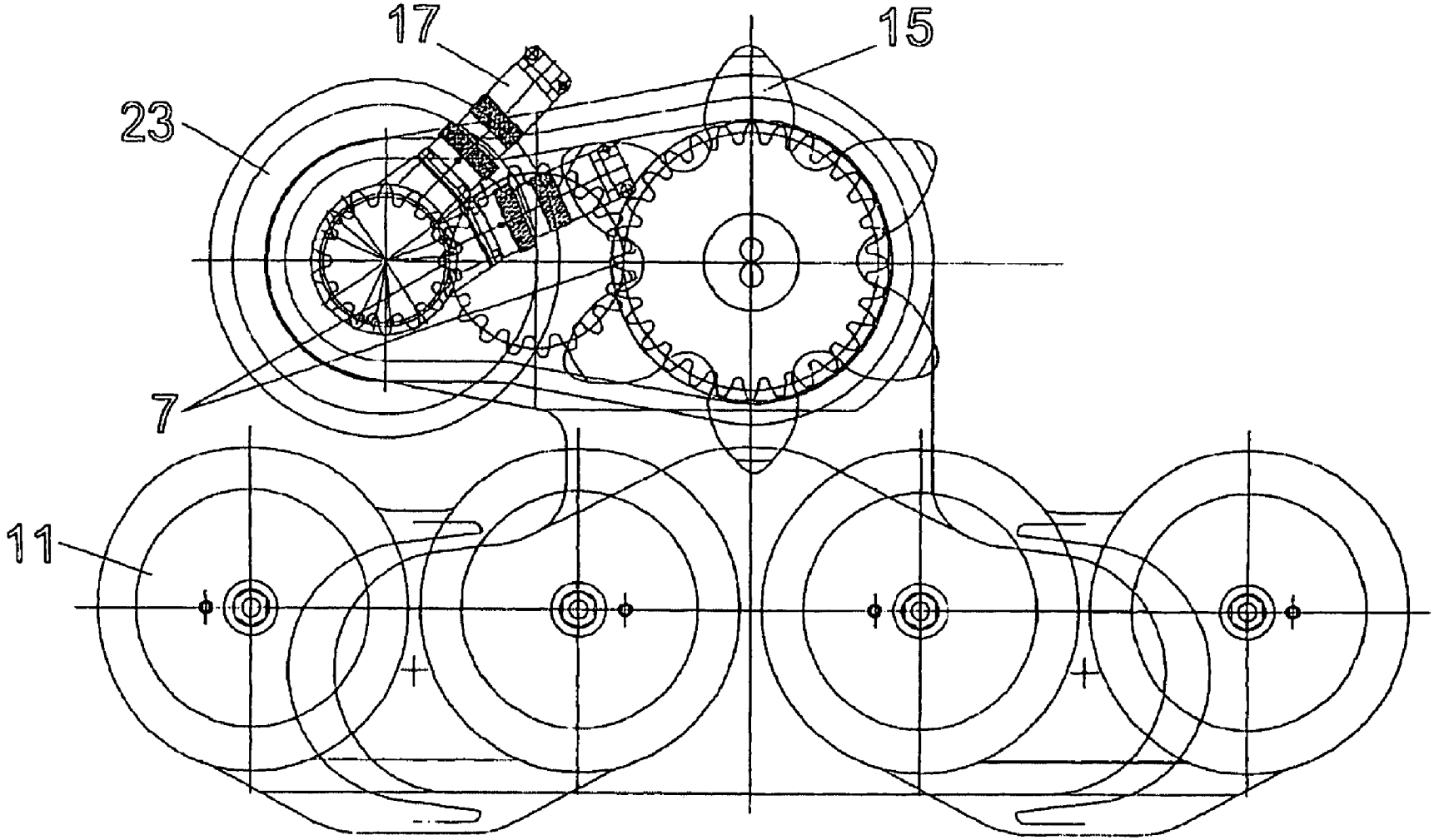
FIG. 6: is a schematic illustration of the region of the braking device.

In FIG. 6, the rail bar braking gear 15 is illustrated enlarged over the roller element 11, which is comprised of four individual rollers. The rail bar braking gear 15 is connected via a gear stage 7 with a braking stage 23 that carries out the braking of the rail bar braking gear. Connected to the braking stage 23 is a rotation encoder 17 that measures the rotational speed of the braking stage and via non-illustrated, in circuit electronics delivers an error signal for the halting of the laying or placement process in the event that the bridge element 2 slips during the placement because the braking effect of the rail bar braking gear 15 is not adequate.

Figure 7:
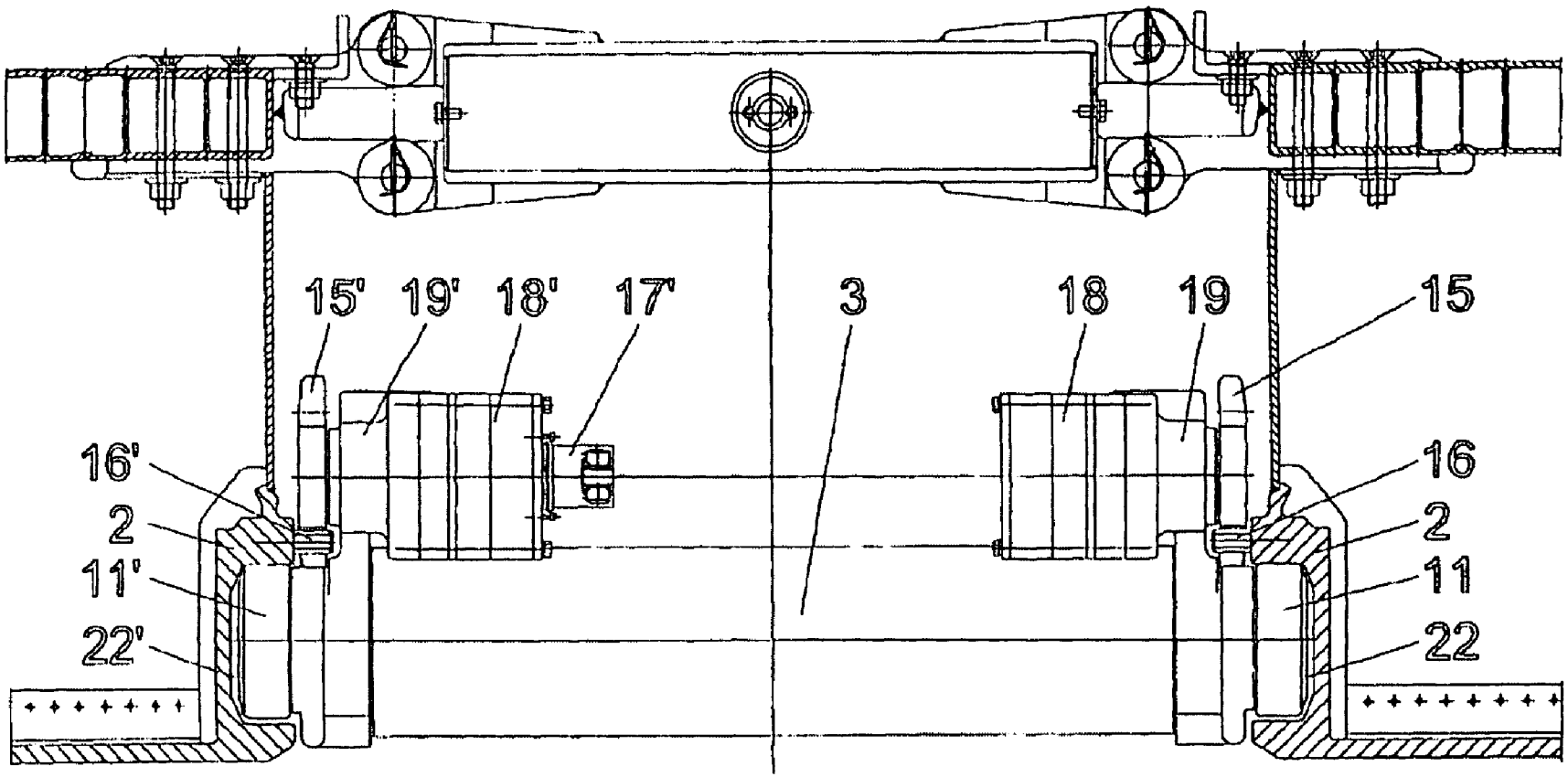
FIG. 7: is a cross-sectional view of the placement arm and the bridge element of FIG. 1, FIG. 8: is a side view of the placement vehicle of FIG. 1 during taking-up of a bridge element supported on a trailer.

The cooperation of the rail bar braking gear 15 with the bridge element 2 is illustrated in FIG. 7, which is a cross-sectional view of the placement arm 3 and the bridge element 2 of FIG. 1. The bridge element 2 is mirror symmetrical to a mirror plane in the longitudinal direction, and is provided with two rail bars having rail bar pins 16 and 16'. Two rail bar braking gears 15 and 15' engage into the rail bars from above. The bridge element is provided with two recessed areas 22 and 22', which serve as guide means. The rollers of the roller group elements 11 and 11' run in the recessed areas 22 and 22' and support the bridge element 2. The rail bar braking gears 15 and 15' are respectively connected via rocker supports 19 and 19' with a spring pressure multiple-disk brake 18 and 18', which brakes the rail bar braking gears.

Figure 8:
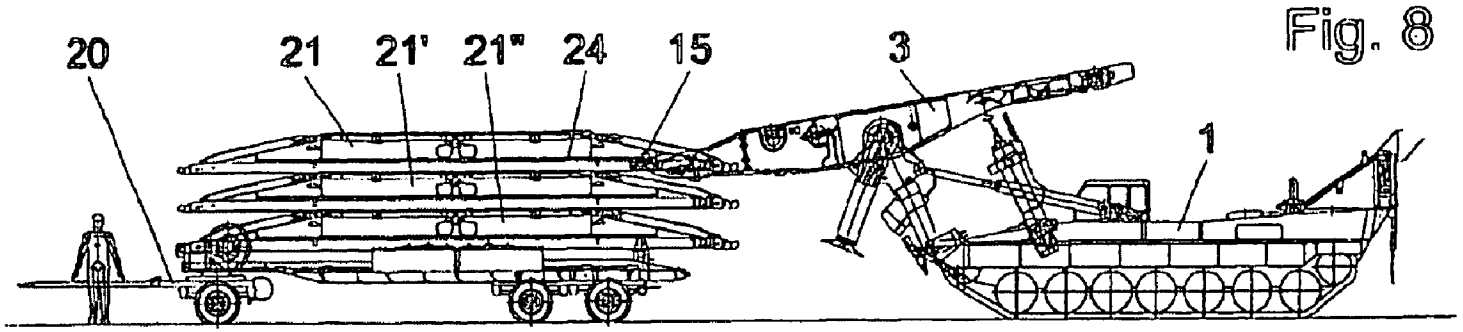
Figure 9:
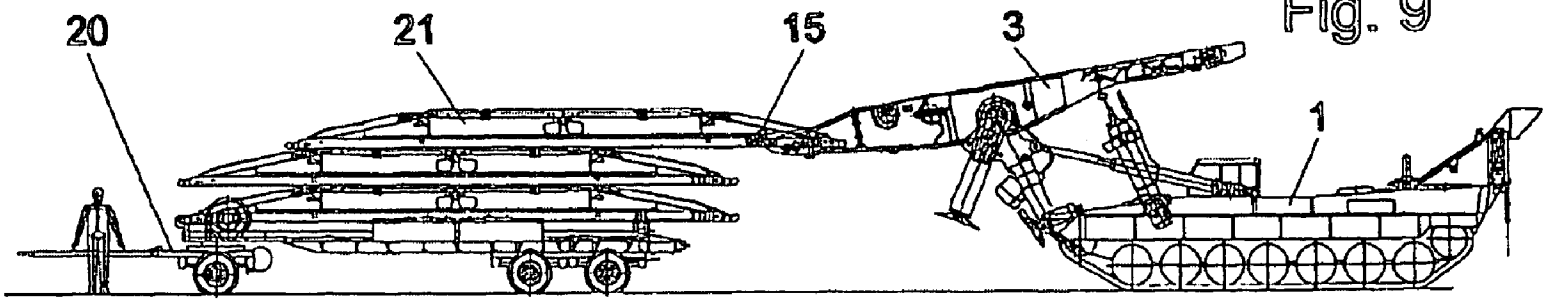
FIG. 9: is a side view of the placement vehicle of FIG. 8 during the taking-up of a bridge element that is supported on a trailer and has been pulled forward.
Figure 10:
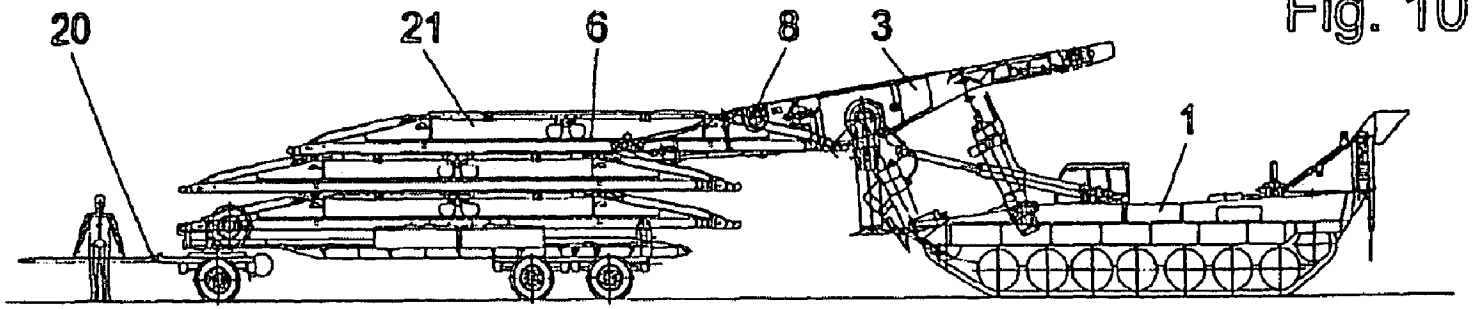
FIG. 10: is a side view of the placement vehicle of FIG. 9 during the taking up of a bridge element supported on a trailer in a position ready for the raising of the bridge element.

FIGS. 8 to 10 show the operating sequence during the taking up of a bridge element 21 that is supported on a trailer 20. A total of three bridge elements 21, 21' and 21" are supported on the trailer. The vehicle 1 is first driven up to bridge element 21 until the rail bar braking gear 15 of the placement arm 3 engages into the rail bar 24 of the bridge element 21 (FIG. 8). The rail bar braking gear 15 is securely braked, and the bridge element 21 is pulled toward the front via the braked rail bar braking gear 15 (FIG. 9). The bridge element 21 is pulled toward the front to such an extent that the rail bar driving gear 8 can engage in to the rail bar 24 of the bridge element 21, so that the bridge element can be taken up by the placement arm 3 (FIG. 10).

The specification incorporates by reference the disclosure of German 10 2006 018 794.6 filed Apr. 22, 2006 and International application PCT/DE2007/000692 filed Apr. 19, 2007.

The present invention is, of course, in no way restricted to the specific disclosure of the specification and drawings, but also encompasses any modifications within the scope of the appended claims.

The invention claimed is:

1. A method for the placement of a bridge element using a vehicle having a pivotable placement arm, including the steps of:

providing said pivotable placement arm with at least one drive element that is adapted to cooperate with the bridge element;

disposing a braking device at a deposition end of said pivotable placement arm, wherein said braking device is adapted to cooperate with the bridge element during a placement procedure, and wherein said braking device is provided as an element that is separate from and in addition to said at least one drive element;

providing an engagement element on said braking device;

placing the bridge element;

and in the event of an uncontrolled movement during the placing of the bridge element, braking the bridge element via said engagement element of said braking device.

2. A method according to claim 1, wherein said drive element is a rail bar driving gear that is adapted to cooperate with a rail bar of the bridge element, and wherein said braking device is a rail bar braking gear.

3. A method for the placement of a bridge element using a vehicle having a pivotable placement arm, including the steps of:

providing said pivotable placement arm with at least one drive element that is adapted to cooperate with the bridge element;

disposing a braking device at a deposition end of said placement arm, wherein said braking device is adapted to cooperate with the bridge element during a placement procedure, and wherein said braking device is provided as an element that is separate from and in addition to said at least one drive element;

measuring and monitoring movement of the bridge element in a longitudinal direction;

providing an engagement element on said braking device;

placing the bridge element;

and in the event of an uncontrolled movement during the placing of the bridge element, braking the bridge element via said engagement element of said braking device.

4. A method according to claim 3, wherein said drive element is a rail bar driving gear that is adapted to cooperate with a rail bar of the bridge element, and wherein said braking device is a rail bar braking gear.

5. A method according to claim 3, which includes the further step of measuring a speed of the movement of the bridge element by means of at least one measurement element.

6. A method according to claim 5, wherein said measurement element is a rotation encoder.

7. A method according to claim 5, which includes the further step of monitoring the speed of the movement of the bridge element by means of a monitoring element that is connected to the measurement element and that in the event of an uncontrolled movement delivers an error signal for a braking of said engagement element of said braking device.

8. An apparatus on a vehicle for the placement of a bridge element, comprising:

a pivotable placement arm having at least one drive element that is adapted to cooperate with the bridge element; and at least one braking device disposed at a deposition end of said pivotable placement arm, wherein said braking device is provided with an engagement element that is adapted to cooperate with the bridge element during a placement procedure, and wherein said braking device is provided as an element that is separate from and in addition to said at least one drive element.

9. An apparatus according to claim 8, wherein said drive element is a rail bar driving gear that cooperates with a rail bar of the bridge element.

10. An apparatus according to claim 8, wherein said engagement element includes a rail bar braking gear that is adapted to engage a rail bar of the bridge element.

11. An apparatus according to claim 8, wherein said braking device includes a braking element that carries out a braking of said engagement element of said braking device.

12. An apparatus according to claim 11, wherein said braking element is a multiple-disk brake.

13. An apparatus according to claim 11, wherein a gear stage is disposed between said engagement element and said braking element.

14. An apparatus according to claim 8, wherein at least one roller element is disposed in the vicinity of said deposition end of said placement arm, and wherein the bridge element is displaceably supported on said at least one roller element.

15. An apparatus according to claim 14, wherein said at least one roller element and said engagement element are arranged in such a way that a rail bar of the bridge element is displaceably disposed between them during a placement procedure.

16. An apparatus according to claim 8, which further comprises a measurement element for measurement of movement of the bridge element.

17. An apparatus according to claim 16, wherein said measurement element is a rotation encoder.

18. An apparatus according to claim 16, which further comprises a monitoring element, in particular electronics, connected to said measurement element for monitoring the movement of the bridge element.

19. An apparatus according to claim 8, which further comprises means for driving said engagement element.

20. The use of the apparatus of claim 8 during a process of taking-up a bridge element disposed in an elevated position, including the steps of:

introducing said placement arm into the bridge element such that said engagement element of said braking device engages into the bridge element;

securely braking said engagement element;

withdrawing the bridge element from the elevated position via the braked engagement element;

releasing the braking of said engagement element;

taking up the bridge element via said at least one drive element of said placement arm.

* * * * *